US009630118B2

(12) United States Patent
Wong et al.

(10) Patent No.: US 9,630,118 B2
(45) Date of Patent: Apr. 25, 2017

(54) CONNECTABLE AND EXTENDABLE DIVING STICK

(71) Applicant: Easebon Services Limited, Kwun Tong (HK)

(72) Inventors: Veronica Pui Chung Wong, Jardine's Lookout (HK); Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 14/533,289

(22) Filed: Nov. 5, 2014

(65) Prior Publication Data

US 2016/0121231 A1 May 5, 2016

(51) Int. Cl.

*A63H 23/00* (2006.01)
*A63H 23/10* (2006.01)
*A63H 23/08* (2006.01)

(52) U.S. Cl.

CPC ..... *A63H 23/10* (2013.01); *A63H 23/08* (2013.01)

(58) Field of Classification Search

USPC ..... 446/71, 107, 108, 109, 120, 124, 153, 446/160, 161; 434/254; 441/1, 55, 129, 441/136

See application file for complete search history.

(56) References Cited

U.S. PATENT DOCUMENTS 4,509,929 A * 4/1985 Zawitz ..... A63H 33/065 446/102
4,666,417 A * 5/1987 Hillman ..... A63H 3/04 428/16
5,009,413 A * 4/1991 Allen ..... A63B 21/0084 446/153
5,110,315 A * 5/1992 Zawitz ..... A63H 33/062 446/102
5,356,132 A * 10/1994 McEwan ..... A63B 71/00 273/336
5,685,752 A * 11/1997 Fulton, Jr. ..... B63C 9/15 441/108
D390,299 S * 2/1998 Terry ..... D11/5
5,741,194 A * 4/1998 Simunek ..... A63C 19/00 473/490
6,056,613 A * 5/2000 Pike ..... B63C 9/135 441/106
6,132,276 A * 10/2000 Leemon ..... B63B 7/04 441/129

(Continued)

OTHER PUBLICATIONS

SPEEDO, "Swim Dive Jacks," Metro Swim Shop, available for sale Oct. 2, 2013 http://www.metroswimshop.com/product.7570452.html?utm_source=PLA's&utm_medium=cpc &gdftrk=gdfV25409_a_7c3098_a_7c11784_a_7c7570452 &gclid=CMSQm-_X-MQCFc8kgQodf1wAlw.

*Primary Examiner* — Kurt Fernstrom
(74) *Attorney, Agent, or Firm* — Amster, Rothstein & Ebenstein LLP

(57) ABSTRACT

A diving toy, or dive stick, that is connectable and extendable. The diving toy includes connectable and/or extendable portions that enables the length of the diving toy to be changed and enable it to be converted into a dive-ring, extended dive stick, larger dive-ring, dive-chain, or a multitude of other amusing shapes. In various games of play, one or more diving toys is thrown into a pool. A player retrieves the diving toy from the bottom of the pool or plays various games of play with the diving toy while submerged underwater.

21 Claims, 6 Drawing Sheets

(56) References Cited

U.S. PATENT DOCUMENTS

| | | | | |
|---|---|---|---|---|
| 6,220,599 | B1 * | 4/2001 | Eisch | A63B 67/007 273/440 |
| 6,332,822 | B2 * | 12/2001 | Greenberg | 446/153 |
| 6,848,663 | B2 * | 2/2005 | Olive | A01G 9/128 248/317 |
| 6,913,505 | B1 * | 7/2005 | Chiang | A63H 23/10 273/350 |
| 7,677,947 | B2 | 3/2010 | Wong | |
| 7,850,505 | B2 | 12/2010 | Wong | |
| 8,453,608 | B2 * | 6/2013 | Lind | A01K 15/02 119/707 |
| 8,490,831 | B1 * | 7/2013 | Wong | A63H 23/10 222/79 |
| 8,651,909 | B2 * | 2/2014 | Romzek | B63B 35/73 114/219 |
| 8,662,952 | B2 | 3/2014 | Wong | |
| 9,108,705 | B2 * | 8/2015 | Hartelius | B63B 35/73 |
| 9,115,508 | B2 * | 8/2015 | Rapoport | B60P 7/06 |
| 9,211,941 | B2 * | 12/2015 | Bartow | B63B 35/85 |
| 2004/0235387 | A1 * | 11/2004 | Thorne, III | A63H 23/06 446/153 |
| 2013/0324003 | A1 * | 12/2013 | Hippely | A63H 18/02 446/153 |

* cited by examiner

CONNECTABLE AND EXTENDABLE DIVING STICK

FIELD

The present invention generally relates to a diving toy that may be submerged in fluid, and in particular, to a diving stick including connectable and/or extendable portions that enable the length of the dive stick to be changed or the dive stick to be converted into a dive-ring.

BACKGROUND OF THE INVENTION

A diving toy, or a dive stick, is an amusement device used in swimming pools. A dive stick may comprise a buoyant body, which may be greater in length than it is in girth. The dive stick may have a weight at one end that is sufficient to cause the body to sink in water and a buoyant portion which will allow the dive stick to stand upright, weighted side down, on the bottom of a swimming pool.

Dive sticks may be used, for example, in training or recreational activities. In some recreational activities, one or more dive sticks may be disposed into a body of fluid, for example, the water of a swimming pool, so that the dive sticks sink to the bottom of the swimming pool and stand vertically due to an at least partially buoyant characteristic of the dive sticks.

During play with these sticks in various games and exercises, several swimmers competing either individually, against each other, or as members of competing teams, dive into the pool and retrieve one or more sticks standing at the bottom of the pool. Besides being a form of amusement, such games and exercises improve the abilities of the swimmers to hold their breath for extended times while completing tasks and otherwise exerting energy to improve their underwater swimming skills.

In one dive stick game, differing point values are assigned to each stick, and swimmers obtain a score according to the total value of the sticks they have retrieved. In another game, swimmers or teams are assigned individual sticks and obtain a score equal to the number of sticks they have retrieved in a single dive. In many games, a diver's ability to readily and visually recognize the value or type of stick is critical to success in the game.

Conventional dive sticks may be designed as a single, stand-alone unit. As such, the level of amusement conventional dive sticks provide and the amount of underwater dive stick games that can be played with them is limited. Furthermore, swimmers using conventional dive sticks for training purposes are often limited not by the depth they can swim to, or their ability to hold breath, but by the amount of dive sticks they can grasp in their hands. This is particularly relevant to younger swimmers who are still learning to swim and dive, but have small hands that are insufficient to pick up or hold more than a few dive sticks at a time. As a result, a swimmer's training efficiency may be affected. It is apparent that there is a need for a dive stick that increases the amount of underwater games that can be played, the level of enjoyment obtained from said games, and a swimmer's training efficiency, to name a few.

Dive-rings overcome the problems associated with conventional dive sticks because users are no longer limited by the number of sticks they can grasp in their hands, which is particularly relevant to children with small hands. For example, the user can wear dive-rings on their arms, legs, neck, head, waist, over the shoulder, or any other body part, thereby allowing the user's hands to remain free to grasp other dive-rings, dive sticks, or any other underwater object. Further, dive-rings can be configured to virtually any diameter. For beginners, dive-rings can be configured in a larger size for easy grasping. Larger dive-rings also allow for increased amusement, such as allowing a swimmer to pass through the dive-ring while underwater, such that the dive-ring is used as a hoop.

SUMMARY OF THE INVENTION

The present invention relates to a dive stick that is connectable and extendable. The connectable and extendable dive stick comprises a flexible body with two ends. A first end of the body has a female connector and a second end of the body has a male connector. The flexible body allows the dive stick to bend so that the female connector can be releasably coupled to the male connector to connect upon itself and form a dive ring. In an exemplary embodiment, the flexible body may be used with other connectable and extendable dive sticks to form longer dive sticks, larger dive rings, dive chains, or a multitude of other amusing shapes. In an exemplary embodiment, a dive stick may be used in a substantially linear configuration. The connectable and extendable nature of the present invention allows for many different combinations that can greatly enhance swimming and underwater amusement as well as provide a myriad of training options for swimmers and divers.

In embodiments, the connectable and extendable dive stick is coupled with other connectable and extendable dive sticks and is formed into appropriately sized rings that may be retrieved from the bottom of a pool and worn on a portion of a user's body, such as a user's arms, legs, neck, head, wrists, waist, and/or ankles, to name a few. In this manner, one or more sized rings may be disposed on a portion of a user while underwater so that the user's hands remain free to capture other dive sticks, dive-rings, and/or other objects. This will allow swimmers, for example, young swimmers with small hands, to improve their diving ability and lung capacity by providing them with increased carrying capacity so that they can retrieve an increased number of objects underwater before surfacing.

In embodiments, the female connector may be releasably coupled to the male connector by way of cantilever snap joint, U-shaped snap joint, torsion snap joint, annular snap joint, friction fit lock, magnetic lock, bayonet lock, threaded fit, interference fit, press fit, hook and loop, or any other joint type, lock type, fit type, or combination thereof, that will allow the female connector and male connector to stay coupled when in use.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures wherein.

DETAILED DESCRIPTION OF THE EXEMPLARY EMBODIMENTS

Figure 1:
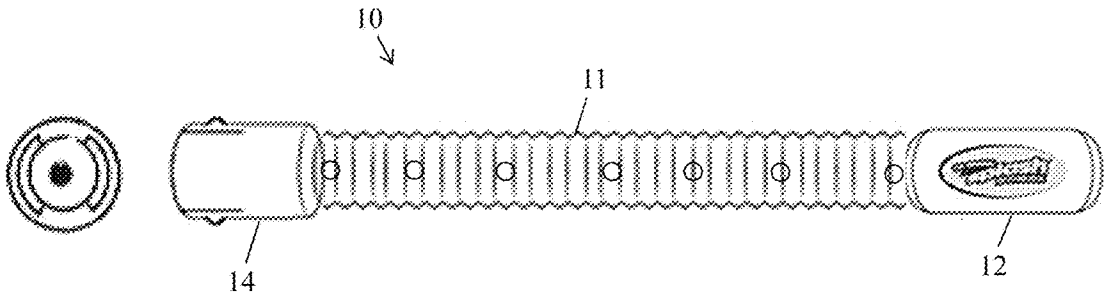
FIG. 1 is a perspective view of the connectable and extendable dive stick.
Figure 2:
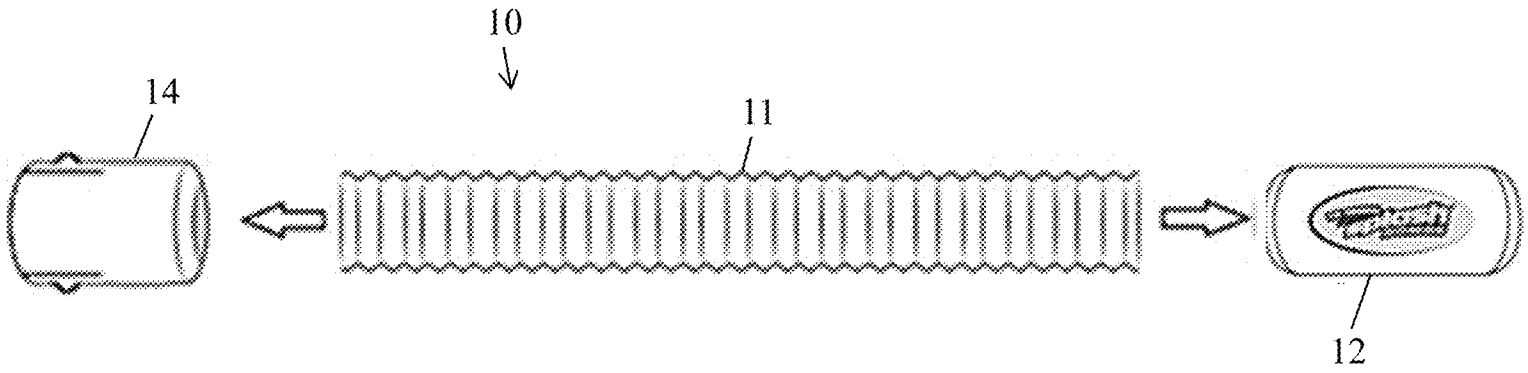
FIG. 2 is an exploded view of the connectable and extendable dive stick.

Initially referring to FIG. 1 and FIG. 2, the embodiment of the connectable and extendable dive stick 10 described herein includes a flexible body 11 affixed to and disposed in between a first end female connector 12 and a second end male connector 14. Female connector 12 and male connector 14 are molded of plastic, preferably ABS, which is less dense than water, in a bright decorative color that both compliments the coloring of the flexible body 11 and eases visibility and identification of the sticks. Flexible body 11 may be a tubular-shaped body comprised of polypropylene, polyvinyl chloride, low density polyethylene, or high density polyethylene, to name a few. Preferably, flexible body 11 is constructed of polypropylene where the polypropylene density of the unweighted end, or the end nearer to the first end female connector, is lower than water and therefore will float. The material preferably allows flexible body 11 to be pliable enough to form connections with other connectable and extendable dive sticks 10. Alternatively, female connector 12, male connector 14, and flexible body 11 may be more dense than water, but capable of retaining air, thereby allowing flotation.

Male connector 14 preferably comprises a ballast 13, which causes male connector 14 to be only insignificantly heavier than female connector 12 when above the water so that there is no significant imbalance during throwing. However, when connectable and extendable dive stick 10 is thrown into a pool of water, ballast 13 causes male connector 14 to be substantially denser than female connector 12 so that dive stick 10 will tend to sink compared to the opposite end of the dive stick or the dive stick sinks to the bottom of the pool with male connector 14 coming to rest at the bottom of the pool and the opposite end standing upwardly. As such, connectable and extendable dive stick 10 will come to rest with male connector 14 on the pool bottom and female connector 12 floating upwards and facing the top of the pool. It is anticipated that the connectable and extendable dive stick 10 can alternatively be configured so that female connector end is heavier than the male connector end so that female connector 12 will come to the rest at the bottom of the pool.

Initially, as the connectable and extendable dive stick 10 is cast into the water, the hollow interior of flexible body 11 is filled with air and the stick is positively buoyant allowing connectable and extendable dive stick 10 to float on the surface of the water. In a short period of time, however, connectable and extendable dive stick 10 sinks to the bottom of the pool. This occurs because one or more of the flexible body 11, female connector 12, and male connector 14 may include water intake vents 15, which allow air to escape and water to enter the portions of the hollow interior of flexible body 11 and/or related components to thereby allow connectable and extendable dive stick 10 to become negatively buoyant and gradually sink towards the bottom surface of the pool.

Games of play and exercises using diving sticks are well known, generally requiring a swimmer to dive into a swimming pool and collect one or more dive sticks, which have previously been cast into the water and stand on the pool's bottom surface. However, because of the foregoing limitations of existing dive sticks, there is a need for a dive stick that is more versatile. The present invention fills that need by providing a dive stick that allows for a myriad of fun games and swim-training options.

Figure 3:
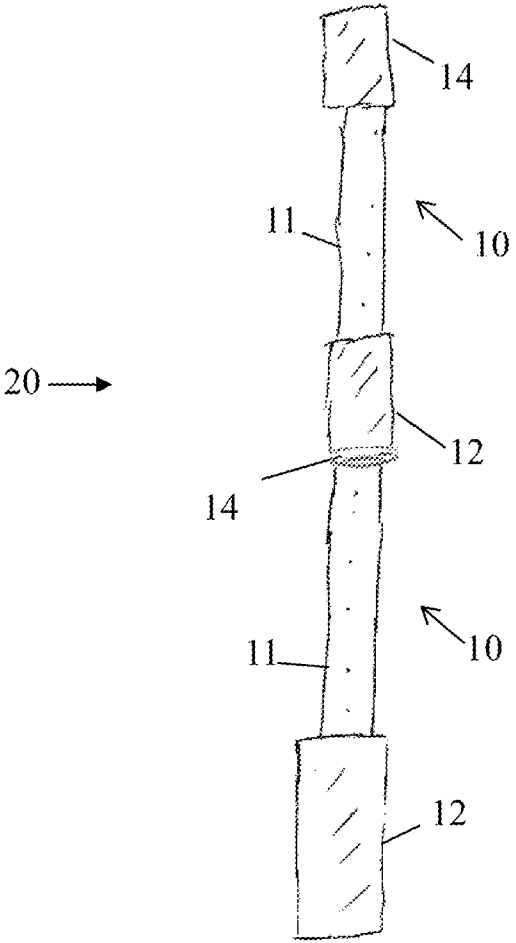
FIG. 3 is a view of multiple connectable and extendable dive sticks connected to form an extended dive stick.

For example, referring now to FIG. 3, which depicts multiple connectable and extendable dive sticks 10 connected in series to form extended dive stick 20. Extended dive stick 20 provides for more overall amusement and training options than conventional dive sticks. In an embodiment, extended dive stick 20 can be used as a rope to guide swimmers along the bottom of a pool's surface. In yet another embodiment, in a game of underwater jump rope, two swimmers hold opposing ends of extended dive stick 20 while another swimmer jumps over it.

In an embodiment, extended dive stick 20 can be used by swimmers still learning diving techniques. Conventional dive sticks are traditionally six to seven inches long and require the swimmer to dive all the way to the bottom of the pool to reach them. Because extended dive stick 20 can be made longer than conventional dive sticks by combining multiple dive sticks of the present invention, and can be configured to virtually any length, it should be appreciated that swimmers do not have to dive as deep into the pool to reach the stick. For example, extended dive stick 20 may comprise several connectable and extendable dive sticks 10 or as little as two connected in series. As the swimmer gradually increases his or her diving ability, the number of sticks can be reduced, resulting in gradually shorter extended dive sticks 20 permitting deeper dives to retrieve the dive stick. Once the swimmer reaches full diving proficiency, only one connectable and extendable dive stick 10 need be used.

In an embodiment, multiple extended dive sticks 20 can be arranged in a slalom configuration, allowing a swimmer to zigzag between extended dive stick 20, now acting as an obstacle, to improve underwater swimming ability. For example, extended dive stick 20 can be configured to vertically reach from the bottom of the pool's surface to the top of the pool's surface. In this way, the swimmer is aware of extended dive stick 20 as an obstacle. While underwater, the swimmer must simultaneously traverse and avoid touching each extended dive stick 20 while swimming through the slalom, or otherwise lose points to his or her overall score, much like slalom skiing or auto slalom racing.

Figure 4:
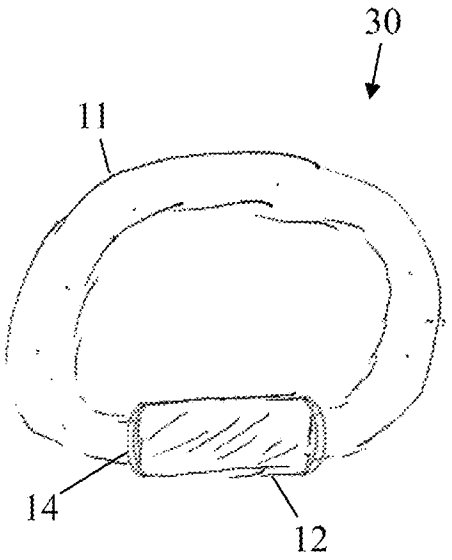
FIG. 4 is dive-ring formed when a single connectable and extendable dive stick is connected upon itself.

Referring now to FIG. 4, which depicts a single connectable and extended dive stick's 10 male connector 14 releasably coupled to its female connector 12 to form single dive-ring 30. It should be appreciated that the ability to form dive-ring 30 from connectable and extendable dive stick 10 greatly enhances fun factor and training options. Such dive sticks 10 can be constructed with either small vents 15 or no vents in flexible body 11. In such a case, air may be retained in flexible body 11 which may cause dive-ring 30 to stand upright and perpendicular to the bottom of the pool's surface, resting on female connector 12, which is releasably coupled to male connector 14. This allows a user to easily grasp dive-ring 30 when underwater. In addition, dive-ring 30 overcomes the problems associated with conventional dive sticks; users are no longer limited by the number of sticks they can grasp in their hands. For example, the user can wear dive-ring 30 on the their arms, legs, neck, head, waist, over the shoulder, or any other body part, thereby allowing the user's hands to remain free to grasp other dive-rings 30 or connectable and extendable dive sticks 10.

In addition, dive-ring 30 can be used in many different ways to increase overall amusement. For example, dive-ring 30 can be worn as pool jewelry, such as a necklace, wristband, earring, ankle bracelet, to name a few. Dive-ring 30 can also be used to play ring toss underwater by setting one connectable and extendable dive stick 10 as the peg and placing dive-ring 30 onto the peg. The swimmer may toss the ring while submerged underwater. Or to increase difficulty, the swimmer may drop dive-ring 30 from the top of the pool while above the water and viewing down on the connectable and extendable dive stick 10. In this way, the swimmer attempts to compensate for the refraction of light by the body of water to correctly place dive-ring 30 onto connectable and extendable dive stick 10.

In an embodiment, dive-ring 30 may possess inherent spring tension depending on the material used for flexible body 11. In one game, multiple dive-rings 30 may be arranged in parallel on the bottom of the pool's surface. Swimmers can arrange the dive-rings in such a way as to use them as a virtual trampoline by pouncing on them with their feet and bouncing along the bottom of the pool's surface from one end of the pool to the other.

Figure 5:
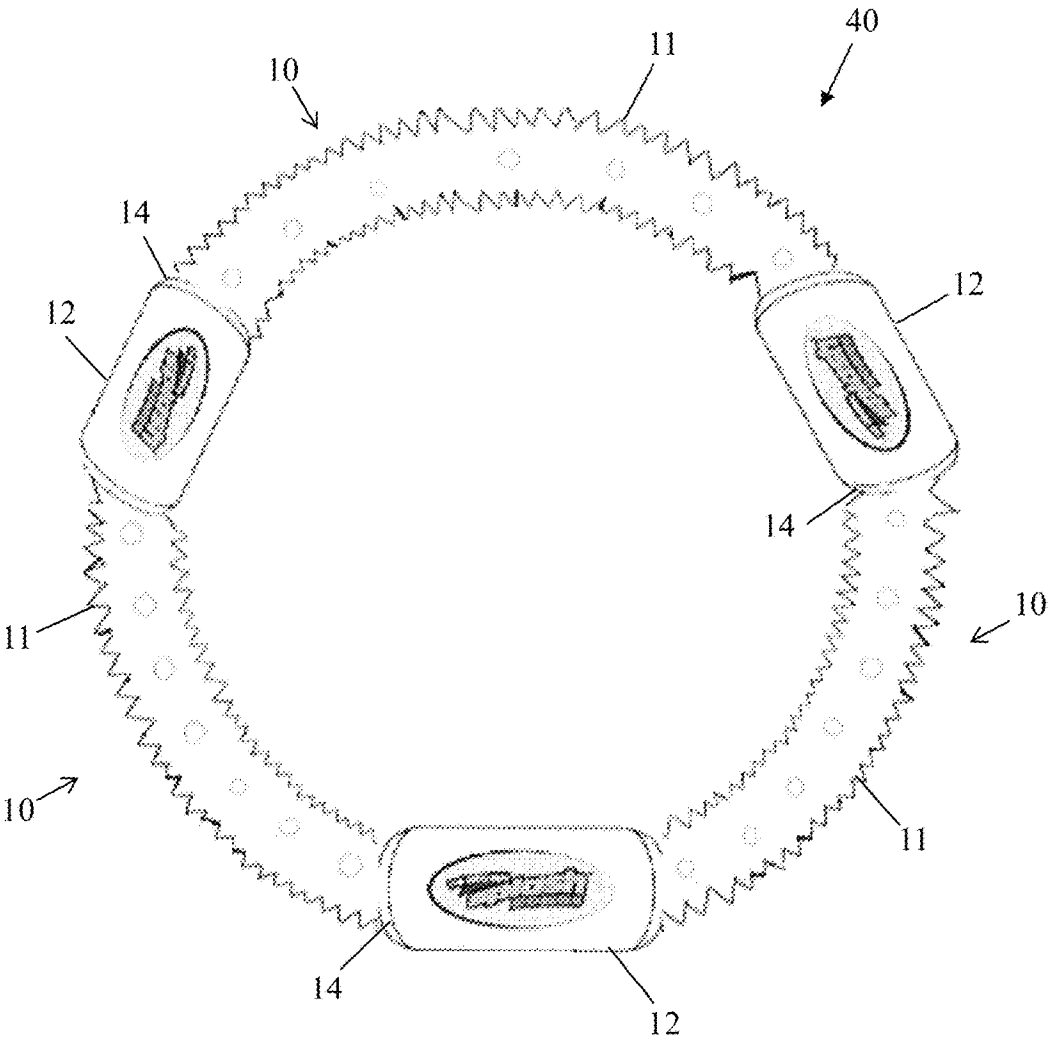
FIG. 5 is view of a large dive-ring formed by connecting multiple connectable and extendable dive sticks in a closed loop configuration.

Referring now to FIG. 5, which depicts a large dive-ring 40 formed by connecting multiple connectable and extendable dive sticks 10 in a closed loop configuration with male connectors 14 engaging a corresponding number of female connectors 12 of the next adjacent dive sticks 10. Large dive-ring 40 can be configured to virtually any diameter by either using larger individual dive sticks 10, more conventional dive sticks 10, or a combination to form the ring. This greatly increases underwater amusement. For example, in one game, large dive-rings 40 can be placed throughout the pool and swimmers can swim through them to improve swimming ability. In this way, swimmers can play the underwater version of hoop jumping, similar to what performers do at the circus. In a variation of the hoop game, swimmers must swim through large dive-ring 40 without touching any portion of the ring. To increase difficulty, large dive-ring 40 can be adjusted in size such that it is only slightly larger than the swimmer's overall width. If the swimmer successfully swims through the large dive-rings 40 without touching any portion of them, then a perfect score is achieved.

Figure 6:
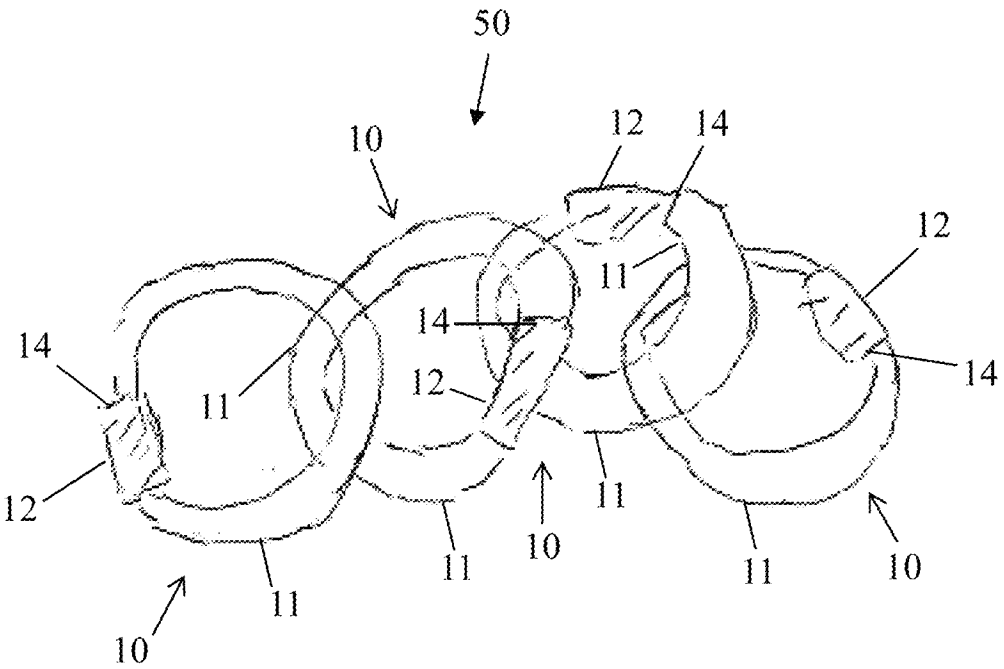
FIG. 6 is a view of multiple dive-rings connected in an overlapping configuration to form a dive-chain.

Referring now to FIG. 6, which depicts a view of multiple dive-rings 20 connected in an overlapping configuration to form a dive-chain 50. Dive-chain 50 can be used to form underwater connections between swimmers to improve overall swimming efficiency or to develop synchronized swimming skills. For example, a first swimmer holds one end of dive-chain 50 and a second swimmer holds the other end. One swimmer may pull the other, or both swimmers can practice swimming at a set distance from one another, using the chain to regulate the swimming distance, which depends on the number of dive-rings 20 used to form dive-chain 50 or the size of each dive stick 10 to form the dive rings 20. Multiple swimmers may also grasp the middle sections of dive-chain 50 to increase difficulty or enhance synchronized swimming skills. In an embodiment, small or large dive-rings 40 may be used to form dive-chain 50.

Referring back to FIGS. 1-6, many variations are considered to increase overall enjoyment of the present invention. In an embodiment, flexible body 11 may include phosphors, which allows the connectable and extendable dive stick 10 to glow in the dark for nighttime use. In an embodiment, female connector 12 may comprise of an assortment of fun shapes and designs, such as a dolphin, shark, snake, tiger, or monkey, to name a few.

In an embodiment, connectable and extendable dive stick 10 may comprise of different lengths to allow for more connective-versatility. For example, connectable and extendable dive stick 10 can come in three inch, six inch, nine inch, or twelve inch sizes, to name a few.

In an embodiment, flexible body 11 can have different cross sections such as triangular, oval-shaped, or trapezoidal, to name a few.

In an embodiment, flexible body 11 is collapsible, thereby allowing a single connectable and extendable dive stick 10 to be retracted in overall length.

In an embodiment, flexible body 11 can be comprised of different diameters.

In an embodiment flexible body 11 may be comprised of a memory polymeric smart material that gives it the ability to maintain a desired shape. This allows the present disclosure to be formed into virtually any shape.

Figure 7:
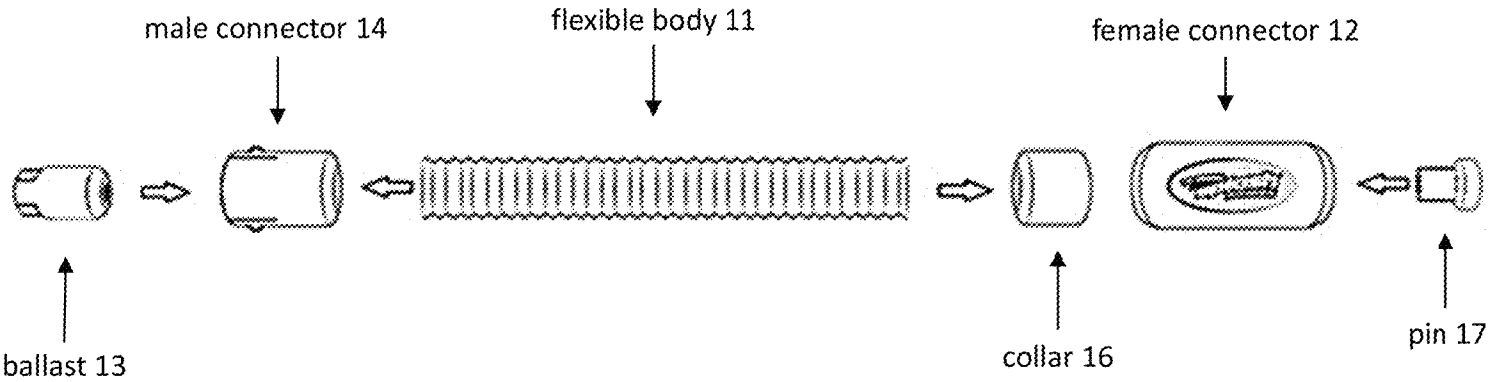
FIG. 7 is an exemplary construction of the connectable and extendable dive stick.

Referring now to FIG. 7, an exemplary embodiment of the connectable and extendable dive stick 10 is shown. In addition to the parts shown in FIG. 2, a collar 16 and a pin 17 are provided. Collar 16 is affixed to flexible body 11. Pin 17 is affixed to collar 16. Collar 16 and pin 17 both have thru-holes to allow the intake of water and act in concert to stay affixed to flexible body 11. Female connector 12 is fitted over collar 16 and pin 17 for a completed assembly.

Now that embodiments of the present invention have been shown and described in detail, various modifications and improvements thereon will become readily apparent to those skilled in the art. Accordingly, the exemplary embodiments of the invention, as set forth above, are intended to be illustrative, not limiting. The spirit and scope of the present invention is to be construed broadly.

What is claimed is:

1. A diving toy, comprising:

a buoyant first end connector a second end connector;

a flexible body extending between the buoyant first end connector and the second end connector and affixed to each of the buoyant first end connector and the second end connector, wherein the buoyant first end connector and the second end connector are releasably engageable to one another or at least one or both of the buoyant first end connector and the second end connector are releasably engageable to one or more additional diving toys such that the diving toy is configured to be capable of use as a single diving stick or dive ring, or, when releasably engaged to the one or more additional diving toys, capable of use in conjunction with the one or more additional diving toys, as an enlarged or extended diving toy, and wherein at least a portion of the diving toy sinks when placed within a body of water.

2. The diving toy of claim 1, further comprising a second diving toy having a buoyant first end connector and a second end connector, wherein, the buoyant first end connector of the first diving toy is engaged to the second end connector of the second diving toy in a linear configuration thereby forming an extended diving stick.

3. The diving toy of claim 1, wherein the flexible body is moveable between a first elongated configuration to a second ring-like configuration when the buoyant first end connector is engaged with the second end connector thereby forming a dive-ring.

4. The diving toy of claim 3, further comprising a second diving toy having a buoyant first end connector and a second end connector, wherein the buoyant first end connector of the first diving toy is engaged to the second end connector of the second diving toy and the second end connector of the first diving toy is engaged to the buoyant first end connector of the last diving toy in a closed-loop configuration forming an enlarged dive ring.

5. The diving toy of claim 1, wherein the diving toy is configured such that when the diving toy sinks in the body of water, the diving toy maintains a substantially upright orientation, wherein the second end connector remains in contact with the bottom of the body of water and the buoyant first end connector is remote from the bottom of the body of water.

6. The diving toy of claim 1, wherein the buoyant first end connector is releasably coupled to the second end connector with at least one of a cantilever snap joint, U-shaped snap joint, torsion snap joint, annular snap joint, friction fit lock, bayonet lock, magnetic lock, hook and loop, threaded fit, interference fit, or press fit to allow the buoyant first end connector and the second end connector to stay coupled when in use.

7. The diving toy of claim 1, wherein the buoyant first end connector contains at least one ballast that causes the buoyant first end connector to be negatively buoyant and sink to the bottom of the body of water.

8. The diving toy of claim 1, wherein the upper-half portion of the flexible body at the second end connector comprises a material having a density lower than water, thereby allowing the diving toy to float in a substantially upright position in the body of water.

9. The diving toy of claim 1, further comprising intake channels in at least one of the flexible body, the buoyant first end connector, and the second end connector that allow an escape of air and an influx of water into the flexible body such that the at least a portion of the diving toy sinks to the bottom of the body of water.

10. The diving toy of claim 1, wherein the flexible body comprises phosphors and glows in the dark.

11. The diving toy of claim 1, wherein the flexible body comprises at least one of a tubular, triangular, square, or oval cross-section.

12. The diving toy of claim 1, wherein the flexible body is collapsible, thereby allowing the diving toy to be retracted in overall length.

13. The diving toy of claim 1, wherein the flexible body comprises a polymeric smart material to allow the diving toy to be formed into and maintain a desired shape.

14. The diving toy of claim 1, further comprising a pin and a collar affixing the flexible body to the second end connector.

15. The diving toy of claim 1, where the shapes of the buoyant first end connector and the second end connector comprise a character design.

16. The diving toy of claim 1, wherein the flexible body has a diameter in a range of from one inch to three inches.

17. The diving toy of claim 1, wherein an overall length of the diving toy ranges from three inches to twelve inches for increased connective versatility.

18. The diving toy of claim 1, wherein the diving toy is releasably engaged to the one or more additional diving toys such that multiple dive-rings are formed and connected in an overlapping configuration to form a dive-chain.

19. The diving toy of claim 1, wherein the diving toy is configured as a dive ring or as an enlarged dive ring, and wherein air retained in the flexible body allows the respective dive ring or enlarged dive ring to stand substantially upright under water.

20. A method of changing a configuration of a diving toy, comprising:

(a) providing a diving toy, the diving toy comprising:
- a buoyant first end connector;
- a second end connector;
- a flexible body extending between the buoyant first end connector and the second end connector and affixed to each of the first buoyant end connector and the second end connector;

wherein the buoyant first end connector and the second end connector are releasably engageable to one another or at least one or both of the buoyant first end connector and the second end connector are releasably engageable to one or more additional diving toys such that the diving toy is configured to be capable of use as a single diving stick or dive ring, or, when releasably engaged to the one or more additional diving toys, capable of use in conjunction with the one or more additional diving toys, as an enlarged or extended diving toy, and wherein at least a portion of the diving toy is sinkable and, when placed within a body of water, submerges to the bottom of the body of water in a substantially upright orientation;

(b) releasably engaging at least one of the buoyant first end connector and the second end connector of the diving toy to form one of the following configurations:

(i) a dive ring, wherein the buoyant first end connector and the second end connector are releasably engaged to one another;

(ii) an extended diving stick, wherein at least one of the buoyant first end connector or the second end connector of the diving toy is releasably engaged to the one or more additional diving toys; or (iii) an enlarged dive ring, wherein the buoyant first end connector and the second end connector of the diving toy are releasably engaged to the one or more additional diving toys; and (c) playing with the diving toy in the body of water.

21. The method of claim 20, further comprising hooking at least one of the dive-ring or the extended dive ring around a user's appendages while submerged in the body of water.

* * * * *